US009779675B2

(12) United States Patent
Park et al.

(10) Patent No.: US 9,779,675 B2
(45) Date of Patent: Oct. 3, 2017

(54) VARIABLE GATE CLOCK GENERATOR, DISPLAY DEVICE INCLUDING THE SAME AND METHOD OF DRIVING DISPLAY DEVICE

(71) Applicant: SAMSUNG DISPLAY CO., LTD., Yongin, Gyeonggi-do (KR)

(72) Inventors: Min-Young Park, Busan (KR); Jeong-Doo Lee, Seoul (KR); Sung-Jun Kim, Cheonan-si (KR); Yun-Mi Kim, Changwon-si (KR); Kyung-Hwa Lim, Yongin-si (KR); Ki-Hyun Pyun, Gwangmyeong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 214 days.

(21) Appl. No.: 14/563,200

(22) Filed: Dec. 8, 2014

(65) Prior Publication Data

US 2016/0027387 A1 Jan. 28, 2016

(30) Foreign Application Priority Data

Jul. 23, 2014 (KR) ..... 10-2014-0093547

(51) Int. Cl.
*G09G 3/36* (2006.01)

(52) U.S. Cl.
CPC ..... *G09G 3/3614* (2013.01); *G09G 3/3611* (2013.01); *G09G 2310/08* (2013.01); *G09G 2320/0233* (2013.01)

(58) Field of Classification Search
CPC ..... G09G 3/3611; G09G 3/3614; G09G 2320/0233; G09G 2310/08
USPC ..... 345/208–210, 211, 94–96
See application file for complete search history.

(56) References Cited

U.S. PATENT DOCUMENTS 5,777,604 A * 7/1998 Okajima ..... G06F 3/045 178/20.03
6,414,670 B1 * 7/2002 Kim ..... G09G 3/3677 345/100
7,224,331 B2 * 5/2007 Yabu ..... G09G 3/22 315/169.1
7,586,476 B2 * 9/2009 Kwon ..... G09G 3/3614 345/100

(Continued)

FOREIGN PATENT DOCUMENTS

KR 1999-016186 3/1999
KR 1020050049383 5/2005

(Continued)

*Primary Examiner* — Lun-Yi Lao
*Assistant Examiner* — Kelly Hegarty
(74) *Attorney, Agent, or Firm* — F. Chau & Associates, LLC

(57) ABSTRACT

A display device includes a display panel, a variable gate clock generator and a gate driver. The display panel includes a plurality of pixels coupled to a plurality of data lines and a plurality of gate lines, respectively. The variable gate clock generator generates a first variable gate clock signal and a second variable gate clock signal having respective duty ratios that are varied depending on a brightness of a frame image. The gate driver generates a plurality of gate driving signals for driving the gate lines in response to the first and second variable gate clock signals.

17 Claims, 12 Drawing Sheets

(56) References Cited

U.S. PATENT DOCUMENTS 8,042,020 B2* 10/2011 Kang ..... H03M 13/43 714/752
8,305,371 B2* 11/2012 Kim ..... G09G 3/3655 345/211
2004/0095308 A1* 5/2004 Kim ..... G09G 3/3648 345/99
2004/0189586 A1* 9/2004 Nagase ..... G09G 3/3648 345/100
2005/0087671 A1* 4/2005 Park ..... G09G 3/3406 250/205
2006/0071936 A1* 4/2006 Leyvi ..... G09G 3/342 345/589
2008/0084378 A1* 4/2008 Lee ..... G09G 3/3677 345/92
2008/0170024 A1* 7/2008 Song ..... G09G 3/3614 345/96
2008/0203929 A1* 8/2008 Park ..... H05B 33/086 315/158
2008/0231623 A1* 9/2008 Ko ..... G09G 3/3685 345/211
2009/0002585 A1* 1/2009 Shimoshikiryoh .. G09G 3/3614 349/39
2010/0109995 A1 5/2010 Fang
2010/0134473 A1* 6/2010 Matsuda ..... G09G 3/3677 345/213
2010/0309214 A1* 12/2010 Cho ..... G09G 3/3426 345/589
2011/0148947 A1* 6/2011 Chen ..... G09G 3/2025 345/690
2011/0169789 A1* 7/2011 Yamaguchi ..... G09G 3/3677 345/204
2012/0194489 A1* 8/2012 Iwamoto ..... G09G 3/3685 345/204
2012/0200544 A1* 8/2012 Iwamoto ..... G09G 3/3685 345/204
2012/0249507 A1 10/2012 Chung et al.
2013/0038639 A1* 2/2013 Han ..... G09G 3/20 345/690
2013/0314361 A1* 11/2013 Saitoh ..... G06F 3/0412 345/173
2014/0015820 A1* 1/2014 Choi ..... G09G 3/3614 345/211
2014/0104328 A1* 4/2014 Kim ..... G09G 3/3225 345/691
2014/0307003 A1* 10/2014 Choi ..... G09G 3/3648 345/690

FOREIGN PATENT DOCUMENTS

KR 1020060131162 12/2006
KR 2014-0134164 11/2014

* cited by examiner

VARIABLE GATE CLOCK GENERATOR, DISPLAY DEVICE INCLUDING THE SAME AND METHOD OF DRIVING DISPLAY DEVICE

CROSS REFERENCE TO RELATED APPLICATION

This application claims priority under 35 U.S.C. §119 to Korean Patent Application No. 10-2014-0093547 filed on Jul. 23, 2014, in the Korean Intellectual Property Office (KIPO), the disclosure of which is incorporated by reference in its entirety herein.

BACKGROUND

1. Technical Field

Exemplary embodiments of the inventive concept relate to a display device, and more particularly to a variable gate clock generator, a display device including the variable gate clock generator and a method of driving a display device.

2. Discussion of Related Art

A liquid crystal display (LCD) device, which uses a thin film transistor (TFT) as a switching element, is widely used. A display panel of the LCD device includes two insulating substrates and a liquid crystal layer between the two insulating substrates, and pixel electrodes and common electrodes are formed on the two insulating substrates, respectively. The pixel electrodes are arranged in a matrix form on one of the two insulating substrates. The pixel electrodes are connected to the switching elements such as the TFTs and receive data voltages row by row. The common electrodes may be formed on the other of the two insulating substrate to receive a common voltage.

In the LCD device, voltages are applied to the electrodes to form an electric field in the liquid crystal layer and a desired image is displayed by adjusting the electric field per pixel. Quality of displayed images may be degraded due to horizontal stripes in the displayed images that may occur due to a difference between a charging ratio when a data voltage is inverted from a negative polarity to a positive polarity and a charging ratio when the data voltage is inverted from the positive polarity to the negative polarity.

SUMMARY

At least one exemplary embodiment of the inventive concept provides a variable gate clock generator capable of efficiently compensating for a charging ratio difference according to the polarity inversion of a data voltage.

At least one exemplary embodiment of the inventive concept provides a display device including a variable gate clock generator capable of efficiently compensating for a charging ratio difference according to the polarity inversion of a data voltage.

At least one exemplary embodiment of the inventive concept provides a method of driving a display device capable of efficiently compensating for a charging ratio difference according to the polarity inversion of a data voltage.

According to an exemplary embodiment of the inventive concept, a display device includes a display panel, a variable gate clock generator and a gate driver. The display panel includes a plurality of pixels coupled to a plurality of data lines and a plurality of gate lines, respectively. The variable gate clock generator generates a first variable gate clock signal and a second variable gate clock signal having respective duty ratios that are varied depending on a brightness of a frame image. The gate driver generates a plurality of gate driving signals for driving the gate lines in response to the first and second variable gate clock signals.

In an exemplary embodiment, a difference between the duty ratios of the first and second variable gate clock signals increases as the brightness of the frame image increases, and the difference between the duty ratios of the first and second variable gate clock signals decreases as the brightness of the frame image decreases.

Each of the first and second variable gate clock signals may have a high duty ratio and a low duty ratio alternatively per frame period.

In an embodiment, the gate driver perform a line-inversion driving operation such that the gate driver generates the odd-numbered gate driving signals in response to the first variable gate clock signal and generates the even-numbered gate driving signals in response to the second variable gate clock signal.

The variable gate clock generator may include a duty ratio control circuit and a selection circuit. The duty ratio control circuit may generate a low duty clock signal and a high duty clock signal based on a frame brightness signal and a main clock signal, such that the frame brightness signal represents the brightness of the frame image, the low duty clock signal has a low duty ratio that decreases according to the brightness of the frame image, and the high duty clock signal has a high duty ratio that increases according to the brightness of the frame image. The selection circuit may select the low and high duty clock signals alternatively in response to a polarity signal to generate the first and second variable gate clock signals, where the polarity signal transitions per frame period.

The duty ratio control circuit may include a digital-to-time converter configured to generate a variable pulse signal in response to the frame brightness signal, the variable pulse signal having a pulse width that varies according to the brightness of the frame image, and a logic circuit configured to generate the low and high duty clock signals based on the variable pulse signal and the main clock signal.

The logic circuit may include a first logic circuit configured to generate a first gate clock signal and a second gate clock signal based on the main clock signal, the first and second clock signals having opposite phases, a second logic circuit configured to generate the low duty clock signal based on the variable pulse signal and the first gate clock signal, and a third logic circuit configured to generate the high duty clock signal based on the variable pulse signal and the second gate clock signal.

The second logic circuit may include an inverter configured to invert the variable pulse signal to generate an inversion pulse signal, and an AND logic gate configured to perform an AND logic operation on the inversion pulse signal and the first gate clock signal to generate the low duty clock signal.

The third logic circuit may include an OR logic gate configured to perform an OR logic operation on the variable pulse signal and the second gate clock signal to generate the high duty clock signal.

The selection circuit may include a first multiplexer configured to generate the first variable gate clock signal by selecting the low duty clock signal when the polarity signal has a first logic level and by selecting the high duty clock signal when the polarity signal has a second other logic level, and a second multiplexer configured to generate the second variable gate clock signal by selecting the high duty clock signal when the polarity signal has the first logic level and by selecting the low duty clock signal when the polarity signal has the second logic level.

The duty ratio control circuit may include a delay circuit configured to delay the main clock signal by a delay time in response to the frame brightness signal to generate a delay clock signal, the delay time varying according to the brightness of the frame image, and a logic circuit configured to generate the low and high duty clock signals based on the main clock signal and the delay clock signal.

The logic circuit may include an OR logic gate configured to perform an OR logic operation on the main clock signal and the delay clock signal to generate the high duty clock signal, and an inverter configured to invert the high duty clock signal to generate the low duty clock signal.

The variable gate clock generator may vary the duty ratios of the first and second variable gate clock signals according to the brightness of the frame image when an enable signal is activated, and maintain the duty ratios of the first and second variable gate clock signals at constant values regardless of the brightness of the frame image when the enable signal is deactivated.

The enable signal may be deactivated when a frame rate is greater than a reference value.

According to an exemplary embodiment of the inventive concept, a variable gate clock generator of a display device includes a duty ratio control circuit and a selection circuit. The duty ratio control circuit generates a low duty clock signal and a high duty clock signal based on a frame brightness signal and a main clock signal, such that the frame brightness signal represents a brightness of a frame image, the low duty clock signal has a low duty ratio that decreases according to the brightness of the frame image, and the high duty clock signal has a high duty ratio that increases according to the brightness of the frame image. The selection circuit selects the low and high duty clock signals alternatively in response to a polarity signal to generate a first variable gate clock signal and a second variable gate clock signal, where the polarity signal transitions per frame period.

The duty ratio control circuit may include a digital-to-time converter configured to generate a variable pulse signal in response to the frame brightness signal, the variable pulse signal having a pulse width that varies according to the brightness of the frame image, and a logic circuit configured to generated the low and high duty clock signals based on the variable pulse signal and the main clock signal.

The duty ratio control circuit may include a delay circuit configured to delay the main clock signal by a delay time in response to the frame brightness signal to generate a delay clock signal, the delay time varying according to the brightness of the frame image, and a logic circuit configured to generate the low and high duty clock signals based on the main clock signal and the delay clock signal.

The selection circuit may include a first multiplexer configured to generate the first variable gate clock signal by selecting the low duty clock signal when the polarity signal has a first logic level and by selecting the high duty clock signal when the polarity signal has a second other logic level, and a second multiplexer configured to generate the second variable gate clock signal by selecting the high duty clock signal when the polarity signal has the first logic level and by selecting the low duty clock signal when the polarity signal has the second logic level.

In a method of driving a display device according to an exemplary embodiment of the inventive concept, a frame brightness signal representing a brightness of a frame image is generated. A low duty clock signal and a high duty clock signal are generated based on the frame brightness signal and a main clock signal. The low duty clock signal has a low duty ratio that decreases according to the brightness of the frame image, and the high duty clock signal has a high duty ratio that increases according to the brightness of the frame image. The low and high duty clock signals are selected alternatively in response to a polarity signal to generate a first variable gate clock signal and a second variable gate clock signal, the polarity signal transitioning per frame period. A plurality of gate driving signals for driving gate lines of the display device are generated in response to the first and second variable gate clock signals.

A difference between the duty ratios of the first and second variable gate clock signals may increase as the brightness of the frame image increases, and the difference between the duty ratios of the first and second variable gate clock signals may decrease as the brightness of the frame image decreases.

According to an exemplary embodiment of the invention, a display device includes a display panel and a gate driver. The display panel includes a plurality of pixels coupled to a plurality of data lines and a plurality of gate lines, respectively. The gate driver is configured to generate gate driving signals for application to the gate lines. The gate driver generates a first one of the gate driving signals with a first duty ratio during a current frame period and a second duty ratio during a subsequent frame. The gate driver generates a second one of the gate driving signals with the second duty ratio during the current frame period and the first duty ratio during the subsequent frame. The duty ratios are equal to one another when a frame image has a minimum brightness and are different from one another otherwise.

BRIEF DESCRIPTION OF THE DRAWINGS

Exemplary embodiments of the inventive concept will be more clearly understood from the following detailed description taken in conjunction with the accompanying drawings.

DESCRIPTION OF EMBODIMENTS

Figure 1:
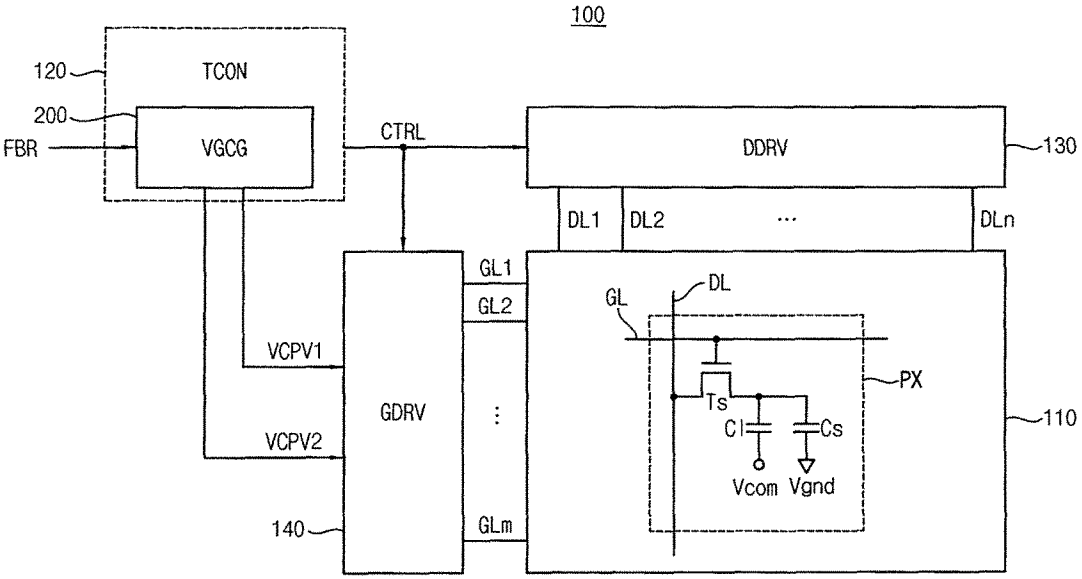
FIG. 1 is a block diagram illustrating a display device according to an exemplary embodiment of the inventive concept.

The exemplary embodiments are described more fully hereinafter with reference to the accompanying drawings. Like or similar reference numerals refer to like or similar elements throughout.

FIG. 1 is a block diagram illustrating a display device according to an exemplary embodiment of the inventive concept.

Referring to FIG. 1, a display device 100 includes a display panel 110, a timing controller (TCON) 120, a data driver (DDRV) 130, and a gate driver (GDRV) 140. Even though not illustrated in FIG. 1, the display device 100 may further include a buffer for storing image data to be displayed, a back light unit, etc.

The display panel 110 includes a plurality of pixels PX coupled to a plurality of data lines DL1~DLn and a plurality of gate lines GL1~GLm, respectively. As illustrated in FIG. 1, each pixel PX includes a switching element Ts, a liquid crystal capacitor Cl and a storage capacitor Cs. The switching element Ts connects the capacitors Cl and Cs to the corresponding data line DLi in response to a gate driving signal transferred through the corresponding gate line GLi. The liquid crystal capacitor Cl is connected between the switching element and the common voltage Vcom, and the storage capacitor Cs is connected between the switching element and the ground voltage Vgnd.

For example, the pixels PX may be arranged in a matrix form of m rows and n columns. The pixels PX in the display panel 110 are connected to the data driver 130 through the data lines DL1~DLn and to the gate driver 140 through the gate lines GL1~GLm.

The data driver 130 provide data signals, that is, data voltages to the display panel 110 through the data lines DL1~DLn. The gate driver 140 provides gate driving signals through the gate lines GL1~GLm for controlling the pixels PX by units of rows. The timing controller 120 controls overall operations of the display device 100. The timing controller 120 may provide control signals CTRL to control the display panel 110, the data driver 130, the gate driver 140, etc. In at least one exemplary embodiment, the timing controller 120, the data driver 130 and the gate driver 140 are implemented as a single integrated circuit (IC). In at least one exemplary embodiment, the timing controller 120, the data driver 130 and the gate driver 140 are implemented as two or more ICs.

The display device 100 includes a variable gate clock generator (VGCG) 200 according to according to an exemplary embodiment of the inventive concept. The variable gate clock generator 200 generates a first variable gate clock signal VCPV1 and a second variable gate clock signal VCPV2 having respective duty ratios that are varied depending on a brightness of a frame image.

For example, the brightness of the frame image may be provided through a frame brightness signal of multiple bits. The frame brightness signal FBR may be provided with frame data from an external device, or the value of the frame brightness signal FBR may be calculated in the display device 100 per frame based on the provided frame data. The frame brightness signal FBR may represent an average brightness value of all pixel data in the frame. Even though the variable gate clock generator 200 is included in the timing controller 120 in FIG. 1, all or at least a portion of the variable gate clock generator 200 may be disposed outside the timing controller 120 or in the gate driver 140.

The gate driver 140 generates a plurality of gate driving signals for driving the gate lines GL1~GLm in response to the first and second variable gate clock signals VCPV1 and VCPV2.

As described below, the activation times of the gate driving signals, that is, the charging times of the pixels PX may be controlled adaptively based on the first and second variable gate clock signals VCPV1 and VCPV2, which have respective duty ratios varied depending on the brightness of the frame image. Accordingly horizontal stripes due to a charging ratio difference may be reduced and thus quality of the displayed image may be enhanced by varying the duty ratios of the gate clock signals depending on the brightness of the displayed image.

Figure 2A:
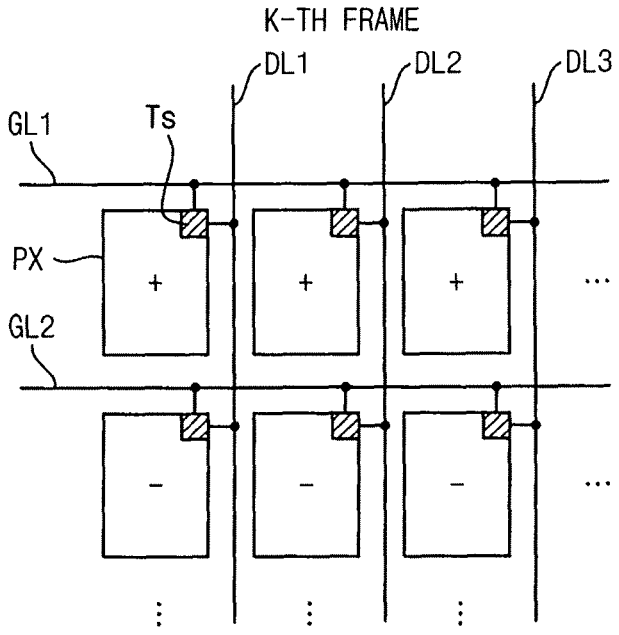
FIGS. 2A and 2B are diagrams for describing a line-inversion driving operation of a display device.
Figure 2B:
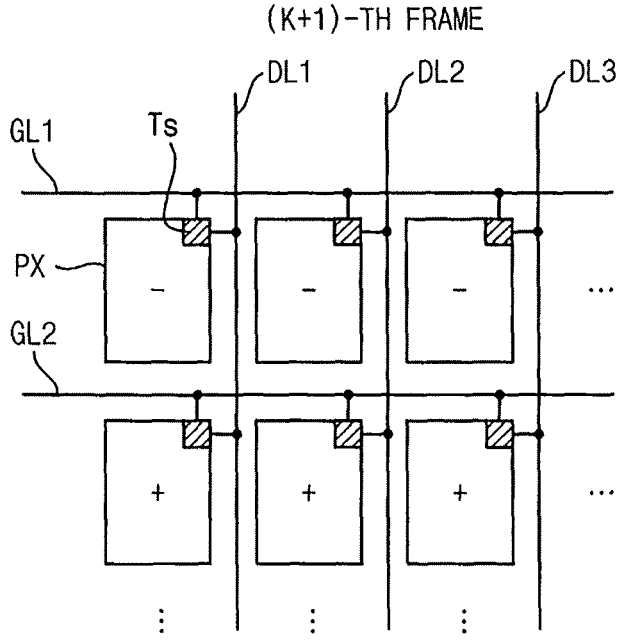
Figure 3:
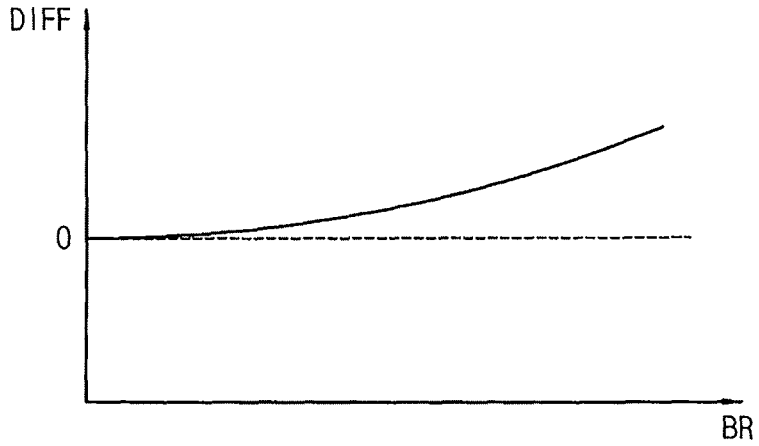
FIG. 3 is a diagram illustrating a charging ratio difference between a positive polarity and a negative polarity according to a brightness of a frame image in a line-inversion driving operation.

FIGS. 2A and 2B are diagrams for describing a line-inversion driving operation of a display device, and FIG. 3 is a diagram illustrating a charging ratio difference between a positive polarity and a negative polarity according to a brightness of a frame image in a line-inversion driving operation.

The liquid crystal may degenerate if a voltage is applied repeatedly in the same direction, and thus an alternative current (AC) voltage is applied to the liquid crystal layer in the display device 100. The application of the AC voltage may be implemented by inverting the polarity of the data voltage applied to each pixel. Applying a data voltage (or the source voltage of the switching element Ts) higher than the common voltage Vcom may be referred to as positive driving and applying a data voltage lower than the common voltage Vcom may be referred to as negative driving. The application of the AC voltage may be implemented with line-inversion driving, dot-inversion driving, etc.

The positive driving (+) and the negative driving (−) are represented with respect to each pixel PX for two sequential frame periods in FIGS. 2A and 2B. In the k-th frame period as illustrated in FIG. 2A, the pixels connected to the odd-numbered gate lines GL1 correspond to the positive driving (+) and the pixels connected to the even-numbered gate lines GL2 correspond to the negative driving (−). In contrast, in the (k+1)-th frame period as illustrated in FIG. 2B, the pixels connected to the odd-numbered gate lines GL1 correspond to the negative driving (−) and the pixels connected to the even-numbered gate lines GL2 correspond to the positive driving (+).

As such, the positive driving (+) and the negative driving (−) may be performed alternatively by units of rows in a frame period and then the polarity is inverted for each row in the next frame period, which may be referred to as line-inversion driving. In an exemplary embodiment, the line-inversion driving is modified by inverting the polarity for two or more rows and/or for two or more frame periods.

It may be difficult to set the pixels to have the same charging ratio for the positive driving (+) and the negative driving (−). The charging ratio or the charging speed indicates a ratio of a real voltage charged to the storage capacitor Cs in the pixel to a desired voltage to be charged, under the condition that the sufficient charging time is not allowed for the high speed operation of the display device. For example, the charging ratio difference may occur because the on-current of the TFT as the switching transistor Ts is different between the positive driving (+) and the negative driving (−). In general, the charging ratio of the positive driving (+) is smaller than the charging ratio of the negative driving (−). Even though the data voltages corresponding to the same brightness are applied to the entire pixels in the frame by the line-inversion driving, the horizontal stripes may be recognized due to such charging ratio differences.

The charging ratio difference (DIFF) according to the brightness (BR) of the displayed image or the frame image is illustrated in FIG. 3. As illustrated in FIG. 3, the charging ratio difference increases and the display quality is degraded as the brightness of the frame image increases. The charging ratio difference may be compensated for by controlling the charging time, that is, the turn-on time of the switching transistor Ts. The horizontal stripes may be relieved by gradually increasing the charging time for the positive driving of the smaller charging ratio and by gradually decreasing the charging time for the negative driving of the greater charging ratio. The charging time corresponds to the activation time of the gate driving signal, and the activation time of the gate driving signal may be determined depending on the activation time of the gate clock signal.

According to an exemplary embodiment of the inventive concept, the horizontal stripes due to a charging ratio difference may be reduced and thus quality of the displayed image may be enhanced by varying the duty ratios of gate clock signals, which determine activation times of the gate driving signals, depending on the brightness of the displayed image and the polarity of the data voltage.

Figure 4:
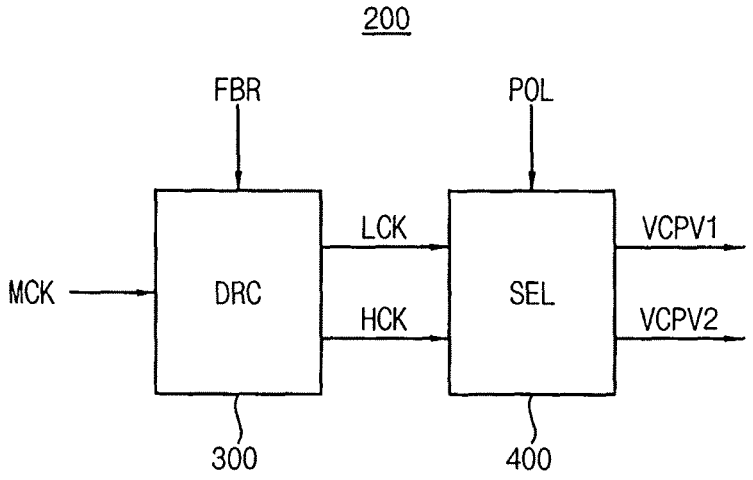
FIG. 4 is a block diagram illustrating a variable gate clock generator according to an exemplary embodiment of the inventive concept.

FIG. 4 is a block diagram illustrating a variable gate clock generator according to an exemplary embodiment of the inventive concept.

Referring to FIG. 4, a variable gate clock generator 200 includes a duty ratio control circuit (DRC) 300 and a selection circuit (SEL) 400.

The duty ratio control circuit 300 generates a low duty clock signal LCK and a high duty clock signal HCK based on a frame brightness signal FBR and a main clock signal MCK, where the frame brightness signal FBR represents the brightness of the frame image. The low duty clock signal has a low duty ratio that decreases according to the brightness of the frame image, and the high duty clock signal has a high duty ratio that increases according to the brightness of the frame image. For example, the duty ratio of the high duty clock signal is higher than the duty ratio of the low duty clock signal. The main clock signal MCK may be provided from an external device. In an exemplary embodiment, the main clock signal MCK has a fixed (e.g., constant) duty ratio of 0.5, that is, 50%.

The selection circuit 400 selects the low and high duty clock signals LCK and HCK alternatively in response to a polarity signal POL to generate the first and second variable gate clock signals VCPV1 and VCPV2, where the polarity signal POL transitions per frame period. In a certain frame period, the first variable gate clock signal VCPV1 corresponds to the low duty clock signal LCK and the second variable gate clock signal VCPV2 corresponds to the high duty clock signal HCK. In the next frame period, the first variable gate clock signal VCPV1 corresponds to the high duty clock signal HCK and the second variable gate clock signal VCPV2 corresponds to the low duty clock signal LCK. As such, each of the first and second variable gate clock signals VCPV1 and VCPV2 has the high duty ratio and the low duty ratio alternatively per frame period.

As described below, the gate driving signals for the positive driving (+) may be generated based on the high duty clock signal HCK and the gate driving signals for the negative driving (−) may be generated based on the low duty clock signal LCK. The selection circuit 400 is controlled in response to the polarity signal POL such that the low and high duty clock signals LCK and HCK are selected alternatively to generate the first and second variable gate clock signals VCPV1 and VCPV2.

Figure 5:
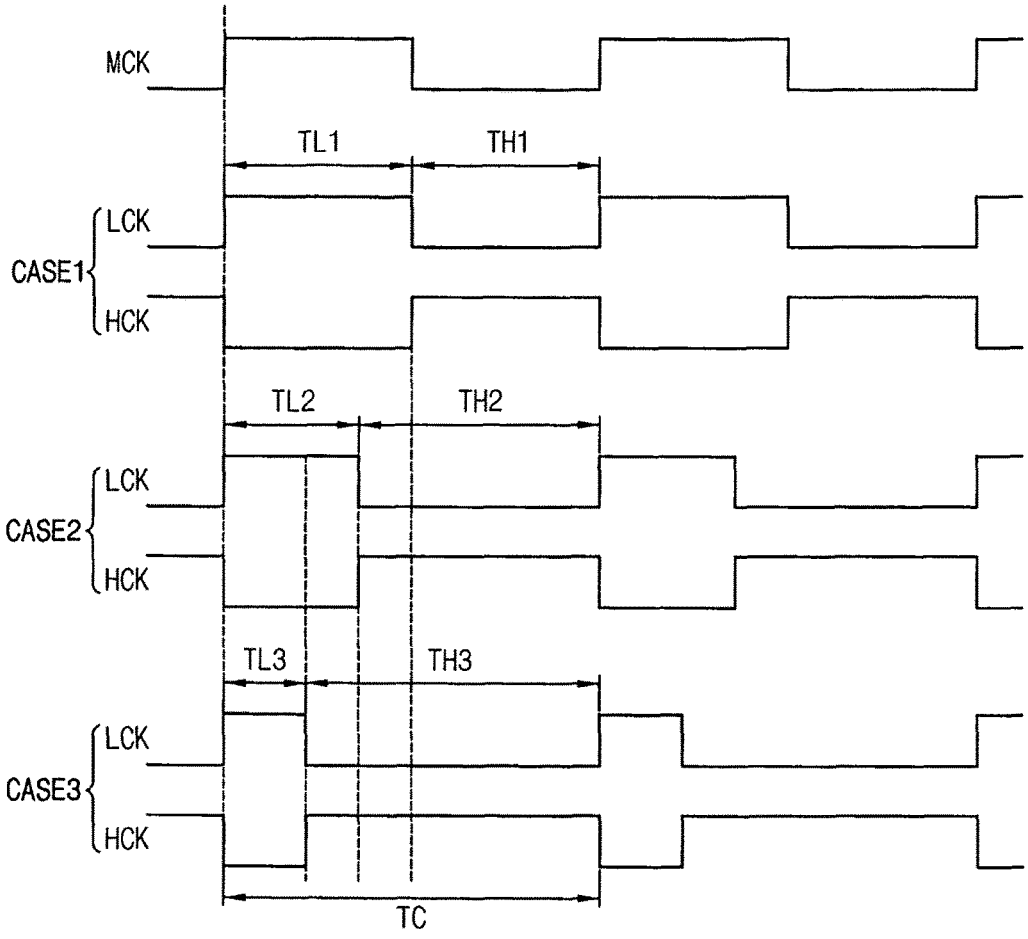
FIG. 5 is a timing diagram illustrating operations of a duty ratio control circuit included in the variable gate clock generator of FIG. 4.

FIG. 5 is a timing diagram illustrating operations of a duty ratio control circuit included in the variable gate clock generator of FIG. 4.

FIG. 5 illustrates the low and high duty clock signals LCK and HCK for three cases of different brightness. The first case corresponds to a case where the brightness of the frame image has a minimum value (e.g., 0 greyscale), the second case corresponds to a case where the brightness of the frame image has an intermediate value (e.g., 100 greyscale, 200 greyscale, etc.) and the third case corresponds to a case where the brightness of the frame image has a maximum value (e.g., 255 greyscale). While the above has used a maximum grayscale of 255 as an example of the maximum brightness, the invention concept is not limited thereto. For example, the intermediate and maximum brightness values may differ based on the number of bits used to represent brightness, which can vary based on the application.

The duty ratio may be defined as a ratio of an activation time of a signal to a sum of the activation time and a deactivation time of the signal. In FIG. 5, the cyclic period of the main clock signal MCK is TC, and the duty ratio of the main clock signal MCK is 0.5 or 50%. With respect to each case, the sum of the activation time TLi (i=1,2,3) of the low duty clock signal LCK and the activation time THi of the high duty clock signal HCK is equal to the cyclic period TC of the main clock signal MCK. In other words, the activation times satisfy TL1+TH1=TL2+TH2=TL3+TH3=TC.

In the first case, the low duty ratio of the low duty clock signal LCK is TL1/TC=0.5, and the high duty ratio of the high duty clock signal HCK is equal to the low duty ratio of 0.5. In the second case, the low duty ratio is TL2/TC (<0.5), which is decreased lower than the first case, and the high duty ratio is TH2/TC (>0.5), which is increased higher than the first case. In the third case, the low duty ratio is TL3/TC, which is further decreased lower than the first and second cases, and the high duty ratio is TH3/TC, which is further increased higher than the first and second cases.

As such, the difference between the duty ratios of the low and high duty clock signals LCK and HCK increases as the brightness of the frame image increases, and the difference between the duty ratios of the low and high duty clock signals decreases as the brightness of the frame image decreases. As described above and illustrated in FIG. 10, the first and second variable gate clock signals VCPV1 and VCPV2 may be generated by alternatively selecting the low and high duty clock signals.

As a result, the difference between the duty ratios of the first and second variable gate clock signals VCPV1 and VCPV2 increase as the brightness of the frame image increases, and the difference between the duty ratios of the first and second variable gate clock signals VCPV1 and VCPV2 decrease as the brightness of the frame image decreases. The gate driving signals may be generated using the first and second variable gate clock signals VCPV1 and VCPV2. Accordingly the charging times may be adjusted adaptively according to the brightness of the frame image and the charging ratio difference between the positive polarity and negative polarity of the data voltages may be compensated for efficiently.

Figure 6:
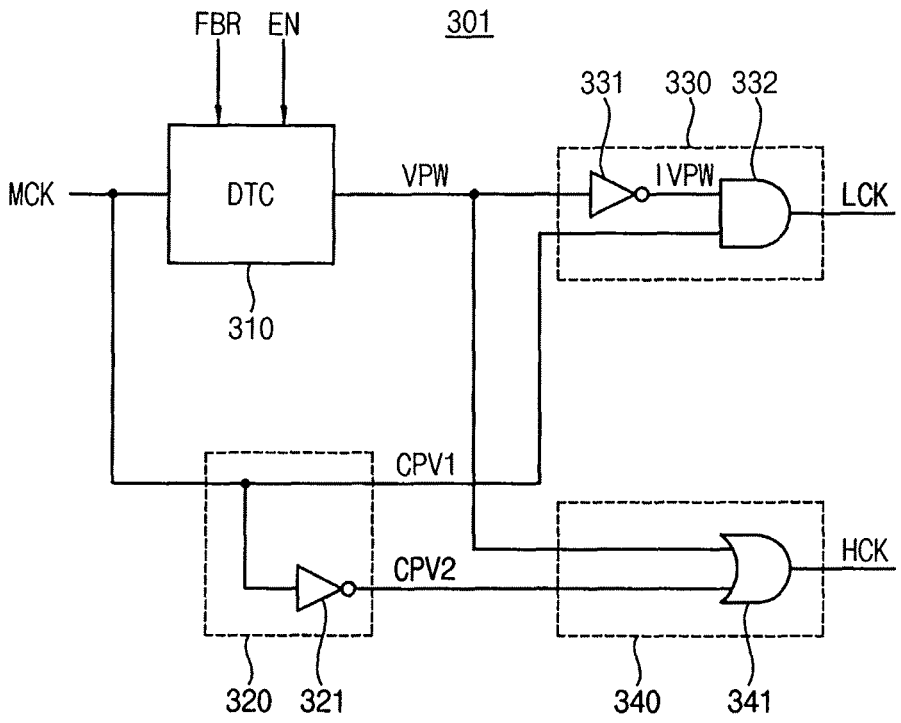
FIG. 6 is a diagram illustrating an example of a duty ratio control circuit included in the variable gate clock generator of FIG. 4 according to an exemplary embodiment of the inventive concept.
Figure 7:
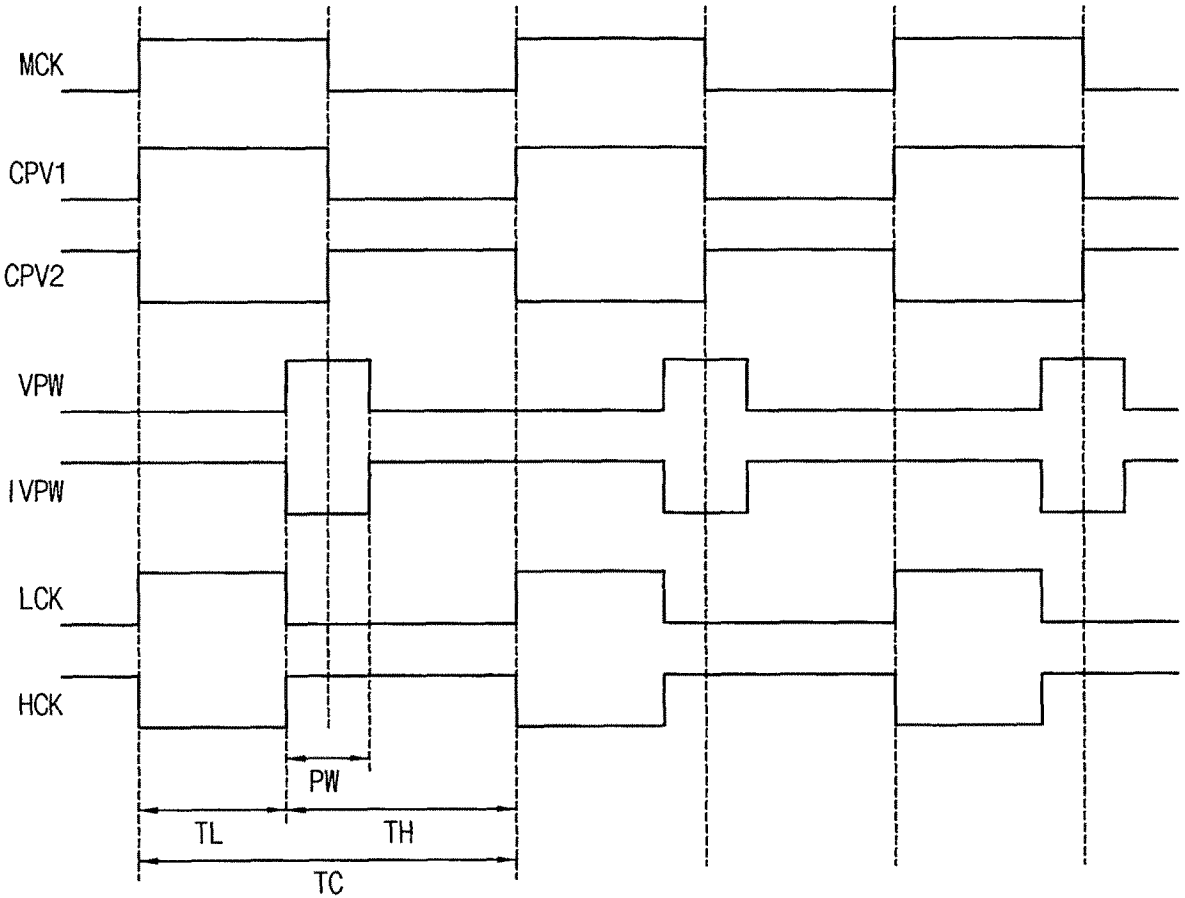
FIG. 7 is a timing diagram illustrating operations of the duty ratio control circuit of FIG. 6.

FIG. 6 is a diagram illustrating an example of a duty ratio control circuit included in the variable gate clock generator of FIG. 4 according to an exemplary embodiment of the inventive concept, and FIG. 7 is a timing diagram illustrating operations of the duty ratio control circuit of FIG. 6.

Referring to FIGS. 6 and 7, a duty ratio control circuit 301 includes a digital-to-time converter (DTC) 310 and a logic circuits 320, 330 and 340. The digital-to-time converter 310 generates a variable pulse signal VPW in response to the frame brightness signal FBW such that the variable pulse signal VPW has a pulse width that varies according to the brightness of the frame image. The logic circuits 320, 330 and 340 generate the low and high duty clock signals LCK and HCK based on the variable pulse signal VPW and the main clock signal MCK.

As illustrated in FIG. 6, the duty ratio control circuit 301 includes a first logic circuit 320, a second logic circuit 330 and a third logic circuit 340. The first logic circuit 320 generates a first gate clock signal CPV1 and a second gate clock signal CPV2 based on the main clock signal MCK, such that the first and second clock signals CPV1 and CPV2 have opposite phases. The second logic circuit 330 generates the low duty clock signal LCK based on the variable pulse signal VPW and the first gate clock signal CPV1. The third logic circuit 340 generates the high duty clock signal HCK based on the variable pulse signal VPW and the second gate clock signal CPV2.

As illustrated in FIG. 6, the first logic circuit 320 includes an inverter 321 to invert the main clock signal MCK to generate the second gate clock signal CPV2. The first gate clock signal CPV1 may correspond to the main clock signal MCK. The duty ratios of the main clock signal MCK and the first and second gate clock signals CPV1 and CPV2 may be equal to each other as 0.5 as illustrated in FIG. 7.

The second logic circuit 330 includes an inverter 331 and an AND logic gate 332. The inverter 331 inverts the variable pulse signal VPW to generate an inversion pulse signal IVPW. The AND logic gate 332 performs an AND logic operation on the inversion pulse signal IVPW and the first gate clock signal CPV1 to generate the low duty clock signal LCK.

The third logic circuit includes an OR logic gate 341 to perform an OR logic operation on the variable pulse signal VPW and the second gate clock signal CPV2 to generate the high duty clock signal HCK.

As such, the duty ratio control circuit 301 may generate the variable pulse signal VPW having the pulse width that varies according to the brightness of the frame image. Using the variable pulse signal VPW, the duty ratio control circuit 301 may generate the low duty clock signal LCK having a low duty ratio that decreases according to the brightness of the frame image and the high duty clock signal HCK having a high duty ratio that increases according to the brightness of the frame image. For example, the low duty ratio may decrease as the brightness increases, whereas the high duty ratio may increase as the brightness increases.

The logic circuits 320, 330 and 340 in FIG. 6 are exemplary embodiments to generate the low and high duty clock signals LCK and HCK as illustrated in FIG. 7. However, in alternate embodiments, the logic circuits 320, 330 and 340 may be modified to different logic as long as they generate substantially the same signals as illustrated in FIG. 7.

The duty ratio control circuit 301 may determine whether to vary the duty ratio or not in response to an enable signal EN as illustrated in FIG. 6. For example, the digital-to-time converter 310 may be enabled to adjust the pulse width PW of the variable pulse signal VPW according to the brightness of the frame image when the enable signal EN is activated, and the digital-to-time converter 310 may be disabled to set the pulse width PW of the variable pulse signal VPW to zero (that is, deactivate the variable pulse signal VPW) regardless of the brightness of the frame image when the enable signal EN is deactivated. For example, when the enable signal EN is deactivated, the variable pulse signal VPW has a constant voltage (e.g., no pulses).

As a result, the variable gate clock generator 200 including the duty ratio control circuit 301 may vary the duty ratios of the first and second variable gate clock signals VCPV1 and VCPV2 according to the brightness of the frame image when the enable signal EN is activated, and maintain the duty ratios of the first and second variable gate clock signals VCPV1 and VCPV2 at constant values regardless of the brightness of the frame image when the enable signal EN is deactivated.

The enable signal EN may be deactivated according to various conditions. For example, the enable signal EN may be deactivated when a frame rate is greater than a reference value. The cyclic period of the gate clock signal decreases as the frame rate of the display device 100 increases. It may be difficult to vary the duty ratio of the gate clock signal if the frame rate is too high and varying the duty ratio may cause errors in the high frame rate. The function of a variable duty ratio may be disabled by deactivating the enable signal EN.

Figure 8:
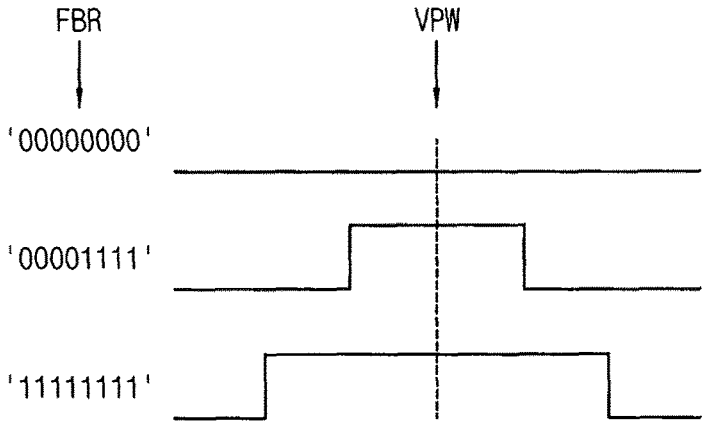
FIG. 8 is a diagram for describing operations of a digital-to-time converter included in the duty ratio control circuit of FIG. 6.

FIG. 8 is a diagram for describing operations of a digital-to-time converter included in the duty ratio control circuit of FIG. 6.

The brightness of the frame image may be provided through the frame brightness signal FBR of multiple bits. For example, the frame brightness signal FBR may be an 8-bit signal having one value from '00000000' to '11111111' as illustrated in FIG. 8. The digital-to-time converter 310 may convert such a digital value to the pulse width PW of the variable pulse signal VPW. The pulse width corresponding to the maximum value '11111111' of the frame brightness signal FBR may be determined through test processes or design simulation. The maximum pulse width may be proportional to the cyclic period of the main clock signal MCK. In an exemplary embodiment, the brighter the frame, the wider the pulse width PW of the variable pulse signal VPW.

Figure 9:
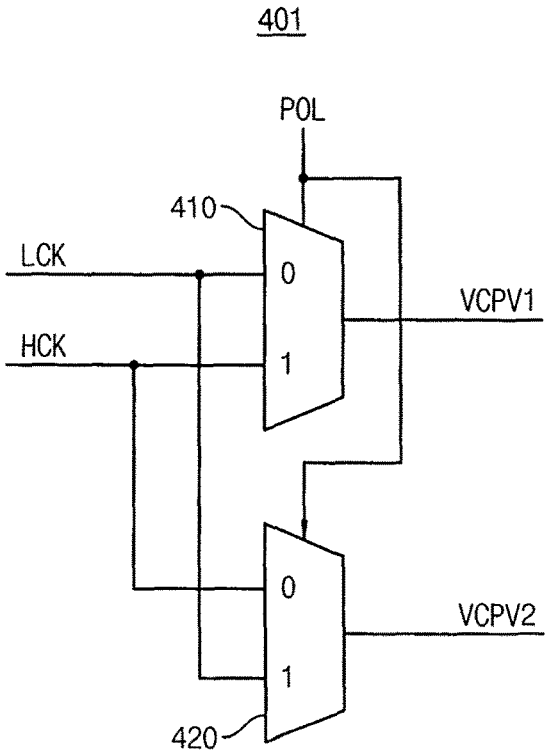
FIG. 9 is a diagram illustrating an example of a selection circuit included in the variable gate clock generator of FIG. 4 according to an exemplary embodiment of the inventive concept.
Figure 10:
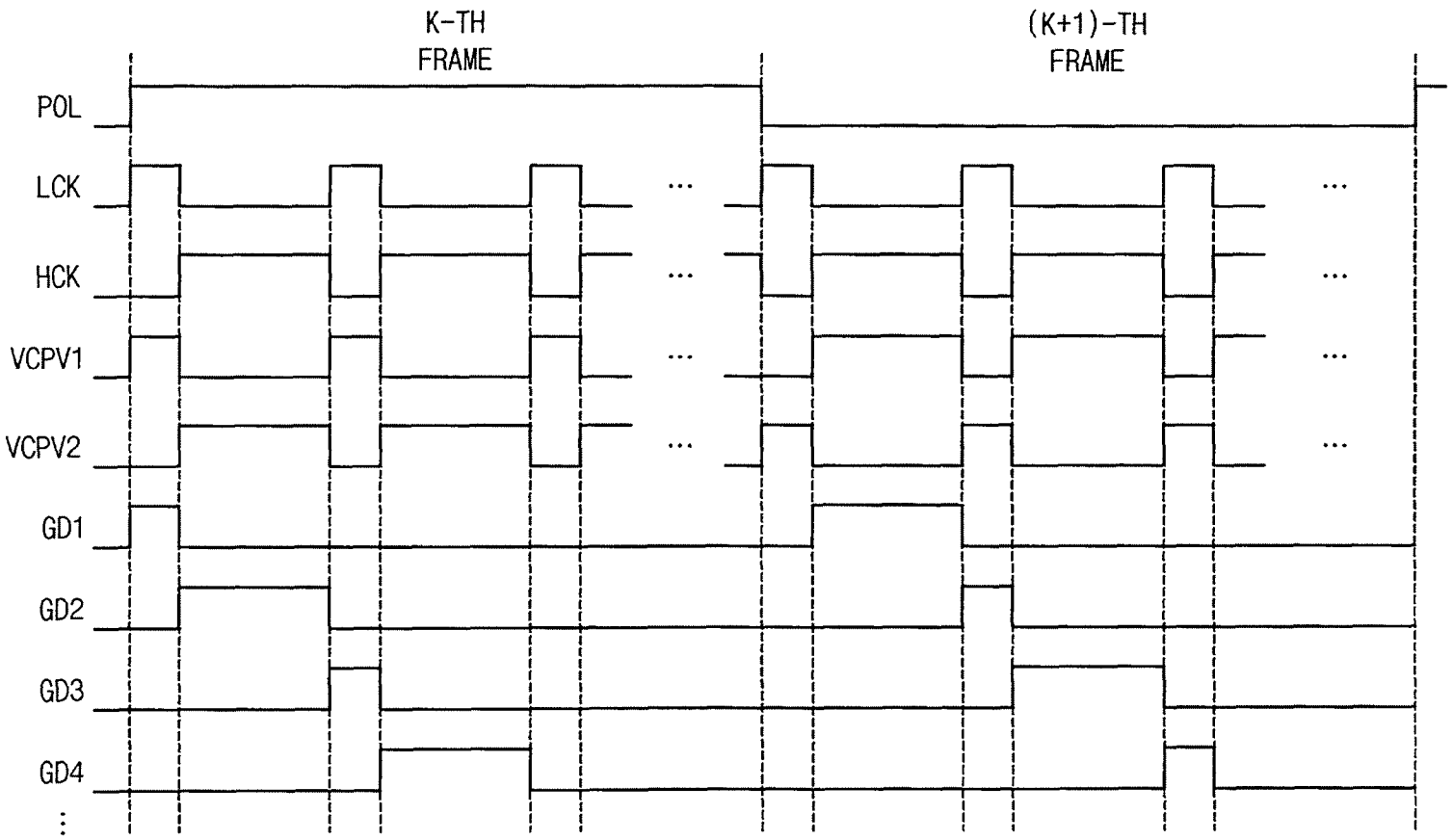
FIG. 10 is a timing diagram illustrating example operations of a display device according to exemplary embodiments of the inventive concept.

FIG. 9 is a diagram illustrating an example of a selection circuit included in the variable gate clock generator of FIG. 4 according to an exemplary embodiment of the inventive concept, and FIG. 10 is a timing diagram illustrating example operations of a display device according to exemplary embodiments of the inventive concept.

Referring to FIG. 9, a selection circuit 401 includes a first multiplexer 410 and a second multiplexer 420. The first and second multiplexers 410 and 420 select the low and high duty clock signals LCK and HCK alternatively in response to a polarity signal POL to generate the first and second variable gate clock signals VCPV1 and VCPV2. The polarity signal POL transitions from a first logic level (e.g., a logic high level) to a second logic level (e.g., a logic low level) or from the second logic level to the first logic level per frame period. The polarity inversion of the data voltages as illustrated in FIGS. 2A and 2B may be performed depending on the logic level transitions of the polarity signal POL.

For example, as illustrated in FIG. 10, the first multiplexer 410 generates the first variable gate clock signal VCPV1 by selecting the low duty clock signal LCK when the polarity signal POL has a first logic level and by selecting the high duty clock signal HCK when the polarity signal POL has a second other logic level. In contrast, the second multiplexer 420 generates the second variable gate clock signal VCPV2 by selecting the high duty clock signal HCK when the polarity signal POL has the first logic level and by selecting the low duty clock signal LCK when the polarity signal POL has the second logic level.

FIG. 10 illustrates the signals for the sequential k-th frame period and (k+1)-th frame period. As described above, the first variable gate clock signal VCPV1 may correspond to the low duty clock signal LCK in the k-th frame period and may correspond to the high duty clock signal HCK in the (k+1)-th frame period. In contrast, the second variable gate clock signal VCPV2 may correspond to the high duty clock signal HCK in the k-th frame period and may correspond to the low duty clock signal LCK in the (k+1)-th frame period.

For performing the line-inversion driving, the gate driver 140 in FIG. 1 may generate the odd-numbered gate driving signals GD1 and GD3 in response to the first variable gate clock signal VCPV1 and may generate the even-numbered gate driving signals GD2 and GD4 in response to the second variable gate clock signal VCPV2. The activation times of the gate driving signals GD1~GD4 may correspond to the turn-on times of the switching elements Ts in the respective pixels, or the charging times of the respective pixels. As such, the charging time may be increased according to the brightness of the frame image in the case of the positive driving (+) and the charging time may be decreased according to the brightness of the frame image in the case of the negative driving (−). As such, the variable gate clock generator and the display device including the variable gate clock generator may reduce the horizontal stripes due to a charging ratio difference and thus enhance quality of the displayed image by varying the duty ratios of gate clock signals, which determine activation times of the gate driving signals, depending on the brightness of the displayed image and the polarity of the data voltage.

Figure 11:
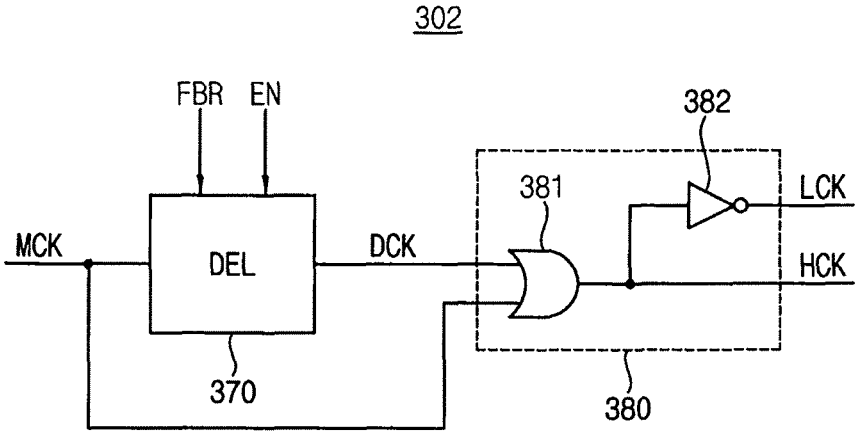
FIG. 11 is a diagram illustrating an example of a duty ratio control circuit included in the variable gate clock generator of FIG. 4 according to an exemplary embodiment of the inventive concept.
Figure 12:
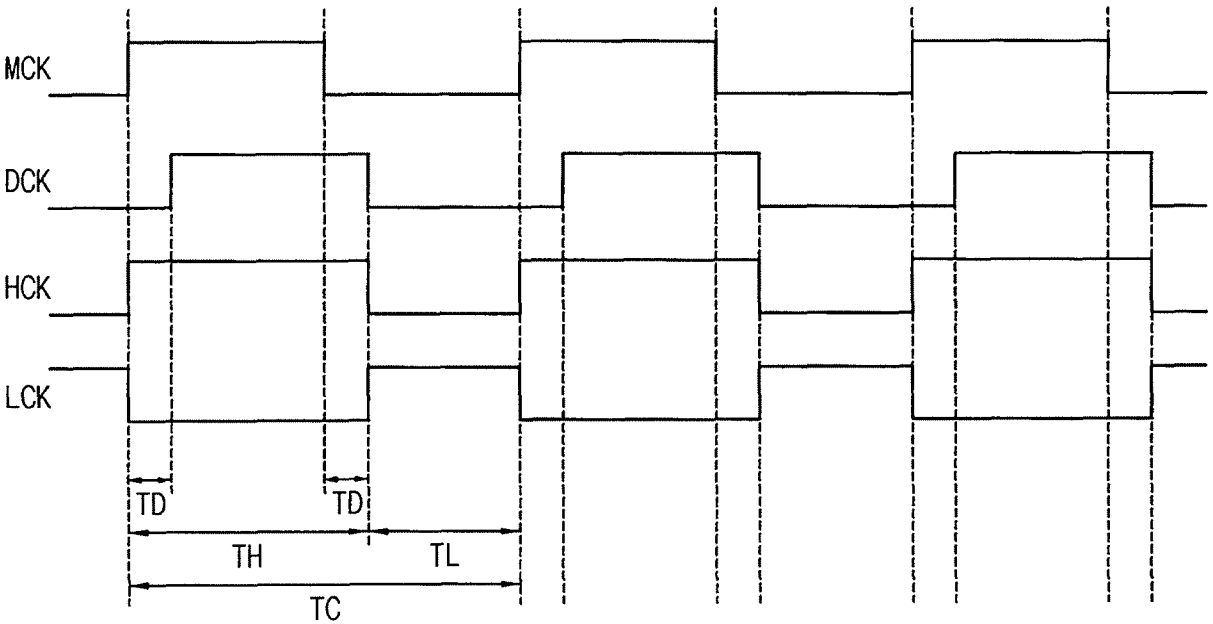
FIG. 12 is a timing diagram illustrating operations of the duty ratio control circuit of FIG. 11.

FIG. 11 is a diagram illustrating an example of a duty ratio control circuit included in the variable gate clock generator of FIG. 4 according to an exemplary embodiment of the inventive concept, and FIG. 12 is a timing diagram illustrating operations of the duty ratio control circuit of FIG. 11.

Referring to FIGS. 11 and 12, a duty ratio control circuit 302 includes a delay circuit (DEL) 370 and a logic circuit 380. In an embodiment, the delay circuit 370 includes one or more buffers connected in series. The delay circuit 370 delays the main clock signal MCK by a delay time TD in response to the frame brightness signal FBR to generate a delay clock signal DCK, where the delay time TD varies according to the brightness of the frame image. In an exemplary embodiment, the greater the brightness the greater the delay time TD. The logic circuit 380 generates the low and high duty clock signals LCK and HCK based on the main clock signal MCK and the delay clock signal DCK.

As illustrated in FIG. 11, the logic circuit 380 includes an OR logic gate 381 and an inverter 382. The OR logic gate 381 performs an OR logic operation on the main clock signal MCK and the delay clock signal DCK to generate the high duty clock signal HCK. The inverter 382 inverts the high duty clock signal HCK to generate the low duty clock signal LCK.

As such, the duty ratio control circuit 302 generates the delay clock signal DCK delayed by the delay time TD that varies according to the brightness of the frame image. Using the delay clock signal DCK, the duty ratio control circuit 301 generates the low duty clock signal LCK having a low duty ratio that decreases according to the brightness of the frame image and the high duty clock signal HCK having a high duty ratio that increases according to the brightness of the frame image. For example, the low duty ratio decreases as the brightness of the frame image increases, and the high duty ratio increases as the brightness of the frame image increases.

The logic circuit 380 in FIG. 11 is an exemplary embodiment to generate the low and high duty clock signals LCK and HCK as illustrated in FIG. 12. However, the logic circuit 380 may be modified to different logic as long as it generates substantially the same signals as illustrated in FIG. 12.

The duty ratio control circuit 302 may determine whether to vary the duty ratio or not in response to an enable signal EN as illustrated in FIG. 11. For example, the delay circuit 370 may be enabled to adjust the delay time TD of the delay clock signal DCK according to the brightness of the frame image when the enable signal EN is activated, and the delay circuit 370 may be disabled to set the delay time TD of the delay clock signal DCK to zero regardless of the brightness of the frame image when the enable signal EN is deactivated.

As a result, the variable gate clock generator 200 including the duty ratio control circuit 302 may vary the duty ratios of the first and second variable gate clock signals VCPV1 and VCPV2 according to the brightness of the frame image when the enable signal EN is activated, and maintain the duty ratios of the first and second variable gate clock signals VCPV1 and VCPV2 to constant values regardless of the brightness of the frame image when the enable signal EN is deactivated.

Figure 13:
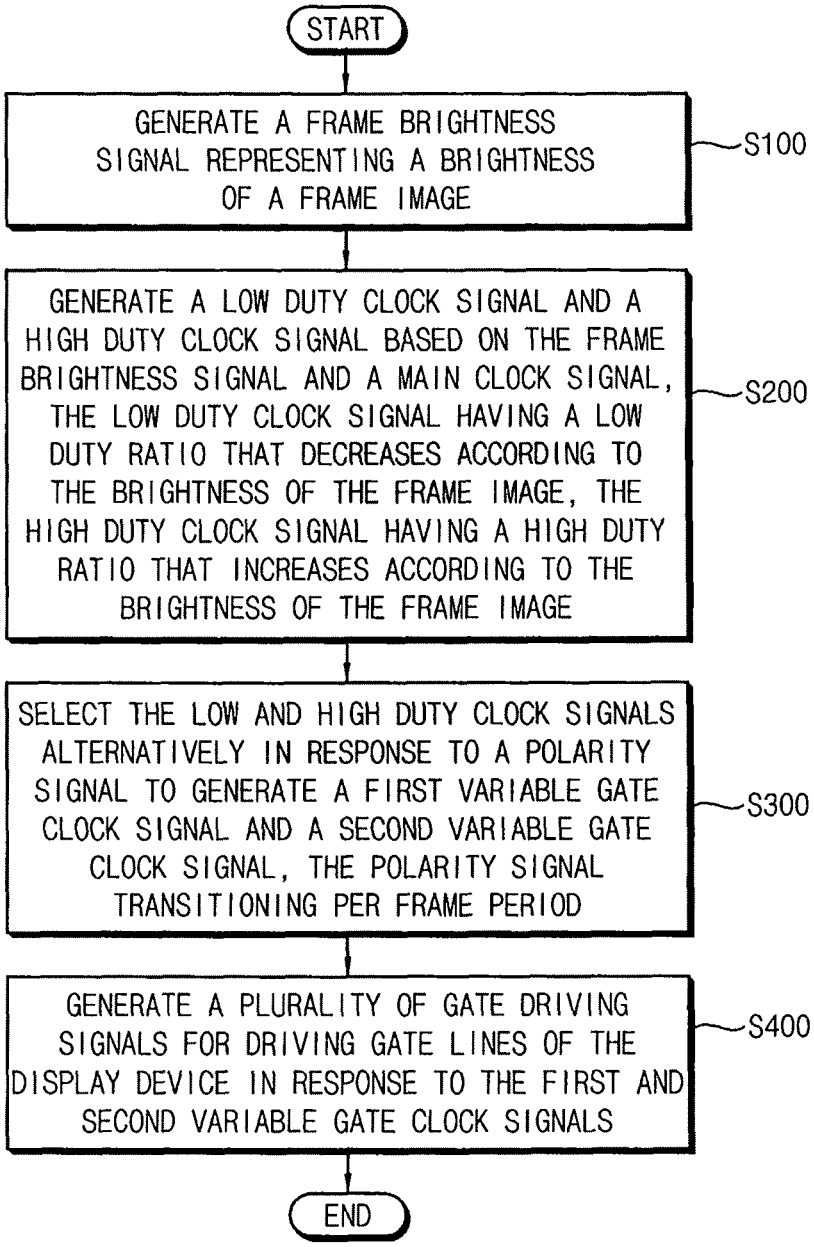
FIG. 13 is a flow chart illustrating a method of driving a display device according to an exemplary embodiment of the inventive concept.

FIG. 13 is a flow chart illustrating a method of driving a display device according to an exemplary embodiment of the inventive concept.

Referring to FIGS. 1, 4 and 13, a frame bright signal FBR is generated representing a brightness of a frame image (S100). The frame brightness signal FBR may be provided with frame data from an external device, or the value of the frame brightness signal FBR may be calculated in the display device 100 per frame based on the provided frame data. The frame brightness signal FBR may represent an average brightness value of all pixel data in the frame.

The duty ratio control circuit 300 in the variable gate clock generator 200 generates a low duty clock signal LCK and a high duty clock signal HCK based on the frame brightness signal FBR and a main clock signal (S200), such that the low duty clock signal LCK has a low duty ratio that decreases according to the brightness of the frame image, and the high duty clock signal HCK has a high duty ratio that increases according to the brightness of the frame image. As described above, the duty ratios of the low and high duty clock signals LCK and HCK may be varied by adjusting the pulse width PW of the variable pulse signal VPW or the delay time TD of the delay clock signal DCK based on the frame brightness signal FBR.

The selection circuit 400 in the variable gate clock generator 200 selects the low and high duty clock signals LCK and HCK alternatively in response to a polarity signal POL to generate a first variable gate clock signal VCPV1 and a second variable gate clock signal VCPV2 (S300), where the polarity signal POL transitions per frame period. The gate driver 140 generates a plurality of gate driving signals for driving gate lines of the display device 110 in response to the first and second variable gate clock signals VCPV1 and VCPV2 (S400). The charging ratio difference may be compensated for efficiently by generating the gate driving signals for the line-inversion driving using the first and second variable gate clock signals VCPV1 and VCPV2.

According to an exemplary embodiment of the inventive concept, a display device includes a display panel (e.g., see 110) having several pixels coupled to a plurality of data lines (e.g., see DL1-DLn) and a plurality of gates lines (e.g., see GL1-GLm), respectively. The display device further includes a gate driver (e.g., see 140) configured to generate gate driving signals for application to the gate lines. The gate driver generates a first one of the gate driving signals (e.g., GD1) with a first duty ratio during a current frame period (e.g., see K-TH frame in FIG. 10) and with a second duty ratio during a subsequent frame (e.g., see (K+1) frame in FIG. 10). The gate driver further generates a second one of the gate driving signals (e.g., GD2) with the second duty ratio during the current frame period and with the first duty ratio during the subsequent frame. When a brightness of a frame image being displayed by the display panel (e.g., during both frames) is at a minimum (e.g., 0 greyscale assuming 255 as a maximum), the first and second duty ratios are substantially equal to one another (e.g., 50%). However, when a brightness of the frame image is greater than the minimum (e.g., 100 greyscale, 200 greyscale, 255 greyscale, etc.), the duty ratios differ from one another. For example, as shown in FIG. 10, the duty ratio of GD1 during the K-TH frame period is a first duty ratio different from a second duty ratio of GD1 during the (K+1)-TH frame period, the duty ratio of GD2 during the K-TH frame period is the second duty ratio, and the duty ratio of GD2 is the first duty ratio during the (K+1)-TH frame period.

Figure 14:
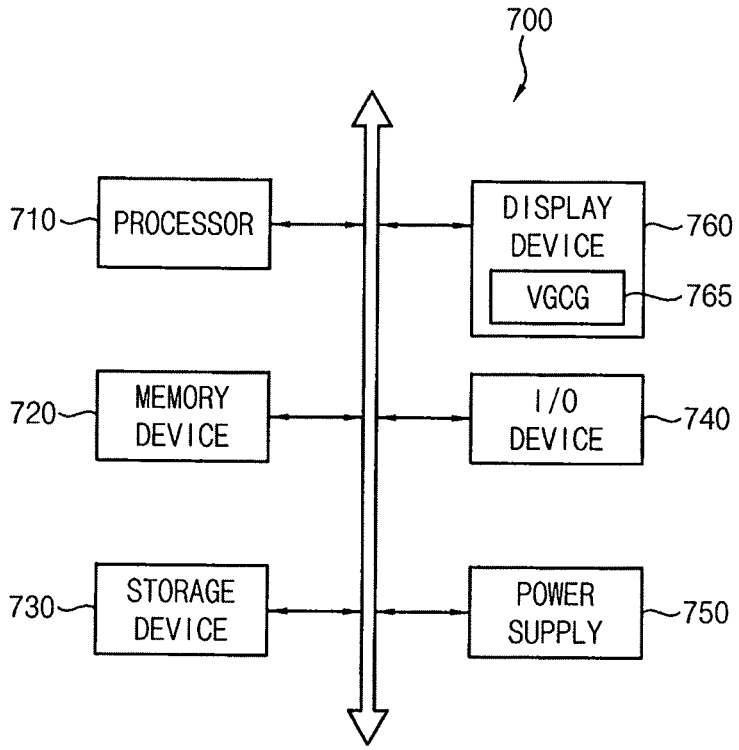
FIG. 14 is a block diagram illustrating a mobile device according to an exemplary embodiment of the inventive concept.

FIG. 14 is a block diagram illustrating a mobile device according to an exemplary embodiment of the inventive concept.

Referring to FIG. 14, a mobile device 700 includes a processor 710, a memory device 720, a storage device 730, an input/output (I/O) device 740, a power supply 750, and a display device 760. The mobile device 700 may further include a plurality of ports for communicating with a video card, a sound card, a memory card, a universal serial bus (USB) device, or other electronic systems.

The processor 710 may perform various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The display device 760 may communicate with other components via the buses or other communication links.

As described above with reference to FIGS. 1 through 13, the display device 760 may include a variable gate clock generator (VGCG) 765. The variable gate clock generator 765 generates the first and second variable gate clock signals VCPV1 and VCPV2 having the respective duty ratios that vary according to the brightness of the frame image.

The present embodiments may be applied to any mobile device or any computing device. For example, the present embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

According to at least one embodiment of the inventive concept, horizontal stripes due to a charging ratio difference may be reduced and thus quality of the displayed image may be enhanced by varying the duty ratios of gate clock signals, which determine activation times of the gate driving signals, depending on the brightness of the displayed image and the polarity of the data voltage.

The foregoing is illustrative of exemplary embodiments of the inventive concept. Although a few exemplary embodiments have been described, those skilled in the art will readily appreciate that many modifications are possible in the these embodiments without materially departing from the disclosure. Accordingly, all such modifications are intended to be included within the scope of the present inventive concept.

What is claimed is:

1. A display device comprising:

a display panel including a plurality of pixels coupled to a plurality of data lines and a plurality of gate lines, respectively;

a variable gate clock generator configured to generate a first variable gate clock signal and a second variable gate clock signal having respective duty ratios that are varied depending on a brightness of a frame image; and a gate driver configured to generate a plurality of gate driving signals for driving gate lines in response to the first and second variable gate clock signals, wherein a first difference between the duty ratios when the brightness is a first value is smaller than a second difference between the duty ratios when the brightness is a second value larger than the first value, wherein the variable gate clock generator is configured to vary the duty ratios of the first and second variable gate clock signals according to the brightness of the frame image when an enable signal is activated, and configured to maintain the duty ratios of the first and second variable gate clock signals at constant values regardless of the brightness of the frame image when the enable signal is deactivated, wherein the enable signal is deactivated when a frame rate is greater than a reference value.

2. The display device of claim 1, wherein a difference between the duty ratios of the first and second variable gate clock signals increases as the brightness of the frame image increases, and the difference between the duty ratios of the first and second variable gate clock signals decreases as the brightness of the frame image decreases.

3. The display device of claim 1, wherein each of the first and second variable gate clock signals has a high duty ratio and a low duty ratio alternatively per frame period.

4. The display device of claim 3, wherein the gate driver is configured to perform a line-inversion driving operation such that the gate driver generates the odd-numbered gate driving signals in response to the first variable gate clock signal and generates the even-numbered gate driving signals in response to the second variable gate clock signal.

5. The display device of claim 1, wherein the variable gate clock generator comprises:

a duty ratio control circuit configured to generate a low duty clock signal and a high duty clock signal based on a frame brightness signal and a main clock signal, the frame brightness signal representing the brightness of the frame image, the low duty clock signal having a low duty ratio that decreases according to the brightness of the frame image, the high duty clock signal having a high duty ratio that increases according to the brightness of the frame image; and a selection circuit configured to select the low and high duty clock signals alternatively in response to a polarity signal to generate the first and second variable gate clock signals, the polarity signal transitioning per frame period.

6. The display device of claim 5, wherein the duty ratio control circuit comprises:

a digital-to-time converter configured to generate a variable pulse signal in response to the frame brightness signal, the variable pulse signal having a pulse width that varies according to the brightness of the frame image; and a logic circuit configured to generate the low and high duty clock signals based on the variable pulse signal and the main clock signal.

7. The display device of claim 6, wherein the logic circuit comprises:

a first logic circuit configured to generate a first gate clock signal and a second gate clock signal based on the main clock signal, the first and second clock signals having opposite phases;

a second logic circuit configured to generate the low duty clock signal based on the variable pulse signal and the first gate clock signal; and a third logic circuit configured to generate the high duty clock signal based on the variable pulse signal and the second gate clock signal.

8. The display device of claim 7, wherein the second logic circuit comprises:

an inverter configured to invert the variable pulse signal to generate an inversion pulse signal; and an AND logic gate configured to perform an AND logic operation on the inversion pulse signal and the first gate clock signal to generate the low duty clock signal.

9. The display device of claim 7, wherein the third logic circuit comprises:

an OR logic gate configured to perform an OR logic operation on the variable pulse signal and the second gate clock signal to generate the high duty clock signal.

10. The display device of claim 5, wherein the selection circuit comprises;

a first multiplexer configured to generate the first variable gate clock signal by selecting the low duty clock signal when the polarity signal has a first logic level and by selecting the high duty clock signal when the polarity signal has a second other logic level; and a second multiplexer configured to generate the second variable gate clock signal by selecting the high duty clock signal when the polarity signal has the first logic level and by selecting the low duty clock signal when the polarity signal has the second logic level.

11. The display device of claim 5, wherein the duty ratio control circuit comprises:

a delay circuit configured to delay the main clock signal by a delay time in response to the frame brightness signal to generate a delay clock signal, the delay time varying according to the brightness of the frame image; and a logic circuit configured to generate the low and high duty clock signals based on the main clock signal and the delay clock signal.

12. The display device of claim 11, wherein the logic circuit comprises:

an OR logic gate configured to perform an OR logic operation on the main clock signal and the delay clock signal to generate the high duty clock signal; and an inverter configured to invert the high duty clock signal to generate the low duty clock signal.

13. A variable gate clock generator of a display device, the variable gate clock generator comprising:

a duty ratio control circuit configured to generate a low duty clock signal and a high duty clock signal based on a frame brightness signal and a main clock signal, the frame brightness signal representing a brightness of a frame image, the low duty clock signal having a low duty ratio that decreases according to the brightness of the frame image, the high duty clock signal having a high duty ratio that increases according to the brightness of the frame image; and a selection circuit configured to select the low and high duty clock signals alternatively in response to a polarity signal to generate a first variable gate clock signal and a second variable gate clock signal, the polarity signal transitioning per frame period, wherein the low duty ratio is lower than the high duty ratio, wherein the duty ratio control circuit is configured to vary the high duty ratio and the low duty ratio according to the brightness of the frame image when an enable signal is activated, and configured to maintain the high duty ratio and the low duty ratio at constant vales regardless of the brightness of the frame image when the enable signal is deactivated, wherein the enable signal is deactivated when a frame rate greater than a reference value.

14. The variable gate clock generator of claim 13, wherein the duty ratio control circuit comprises:

a digital-to-time converter configured to generate a variable pulse signal in response to the frame brightness signal, the variable pulse signal having a pulse width that varies according to the brightness of the frame image; and a logic circuit configured to generate the low and high duty clock signals based on the variable pulse signal and the main clock signal.

15. The variable gate clock generator of claim 13, wherein the duty ratio control circuit comprises:

a delay circuit configured to delay the main clock signal by a delay time in response to the frame brightness signal to generate a delay clock signal, the delay time varying according to the brightness of the frame image; and a logic circuit configured to generate the low and high duty clock signals based on the main clock signal and the delay clock signal.

16. The variable gate clock generator of claim 13, wherein the selection circuit comprises:

a first multiplexer configured to generate the first variable gate clock signal by selecting the low duty clock signal when the polarity signal has a first logic level and by selecting the high duty clock signal when the polarity signal has a second other logic level; and a second multiplexer configured to generate the second variable gate clock signal by selecting the high duty clock signal when the polarity signal has the first logic level and by selecting the low duty clock signal when the polarity signal has the second logic level.

17. A display device comprising:

a display panel including a plurality of pixels coupled to a plurality of data lines and a plurality of gate lines, respectively; and a gate driver configured to generate gate driving signals for application to the gate lines, wherein the gate driver generates a first one of the gate driving signals with a first duty ratio during a current frame period and a second duty ratio during a subsequent frame, wherein the gate driver generates a second one of the gate driving signals with the second duty ratio during the current frame period and the first duty ratio during the subsequent frame, and wherein the duty ratios are equal to one another when a frame image has a minimum brightness and the duty ratios are different from one another otherwise, wherein a difference between the duty ratios increases as the brightness of the frame image increases, and the difference between the duty ratios decreases as the brightness of the frame image decreases, wherein the duty ratios are configured to be varied according to the brightness of the frame image when an enable signal is activated, and configured to be at constant values regardless of the brightness of the frame image when the enable signal is deactivated, wherein the enable signal is deactivated when a frame rate is greater than a reference value.

* * * * *